United States Patent [19]

van Weele

[11] 4,407,612

[45] Oct. 4, 1983

[54] SOIL AND/OR WATER-RETAINING WALL; METHOD FOR FORMING THIS SOIL AND/OR WATER-RETAINING WALL; AND FORMING MOULD SUITABLE FOR USE WITH THIS METHOD

[75] Inventor: Abraham F. van Weele, Waddinxveen, Netherlands

[73] Assignee: Foundacon BV, Netherlands

[21] Appl. No.: 212,091

[22] PCT Filed: Jan. 30, 1980

[86] PCT No.: PCT/NL80/00003

§ 371 Date: Sep. 30, 1980

§ 102(e) Date: Sep. 24, 1980

[87] PCT Pub. No.: WO80/01582

PCT Pub. Date: Aug. 7, 1980

[30] Foreign Application Priority Data

Jan. 30, 1979 [NL] Netherlands ..... 7900704

[51] Int. Cl.[3] ..... E02D 5/00

[52] U.S. Cl. ..... 405/285; 405/258; 405/284

[58] Field of Search ..... 405/284–287, 405/11–14, 258

[56] References Cited

U.S. PATENT DOCUMENTS

| | | | |
|---|---|---|---|
| 1,423,436 | 7/1922 | Larsen | 405/258 X |
| 3,381,483 | 5/1968 | Huthsing | 405/285 X |
| 3,555,830 | 1/1971 | York | 405/285 |
| 4,050,254 | 9/1977 | Meheen et al. | 405/285 |

FOREIGN PATENT DOCUMENTS

| | | | |
|---|---|---|---|
| 812463 | 10/1951 | Fed. Rep. of Germany | 405/285 |
| 972939 | 2/1951 | France | 405/284 |
| 1095729 | 6/1955 | France | 405/285 |
| 694233 | 9/1965 | Italy | 405/285 |
| 22329 | of 1891 | United Kingdom | 405/285 |

*Primary Examiner*—Dennis L. Taylor

*Attorney, Agent, or Firm*—Kane, Dalsimer, Kane, Sullivan and Kurucz

[57] ABSTRACT

The invention relates in the first place to a soil and/or water-retaining wall.

In accordance with the invention this wall is composed of at least partially prefabricated load-bearing uprights and intervening curved shells, formed in the soil of concrete or similar hardenable material, which connect on both sides in jointless fashion to the uprights.

The invention furthermore comprises a method for the formation of this soil and/or water-retaining wall.

According to this method prefabricated uprights are introduced into the soil at a distance from each other, whereafter, for the formation in the soil of an intervening curved shell, a forming mould is introduced into the soil between consecutive uprights and is subsequently withdrawn again, whereby during this withdrawal a mortar is fed into the cavity underneath the mould and fills this cavity.

Finally the invention comprises a forming mould suitable for use with this method. This mould has such dimensions that the same is introduced between the uprights with a clamping fit.

7 Claims, 11 Drawing Figures

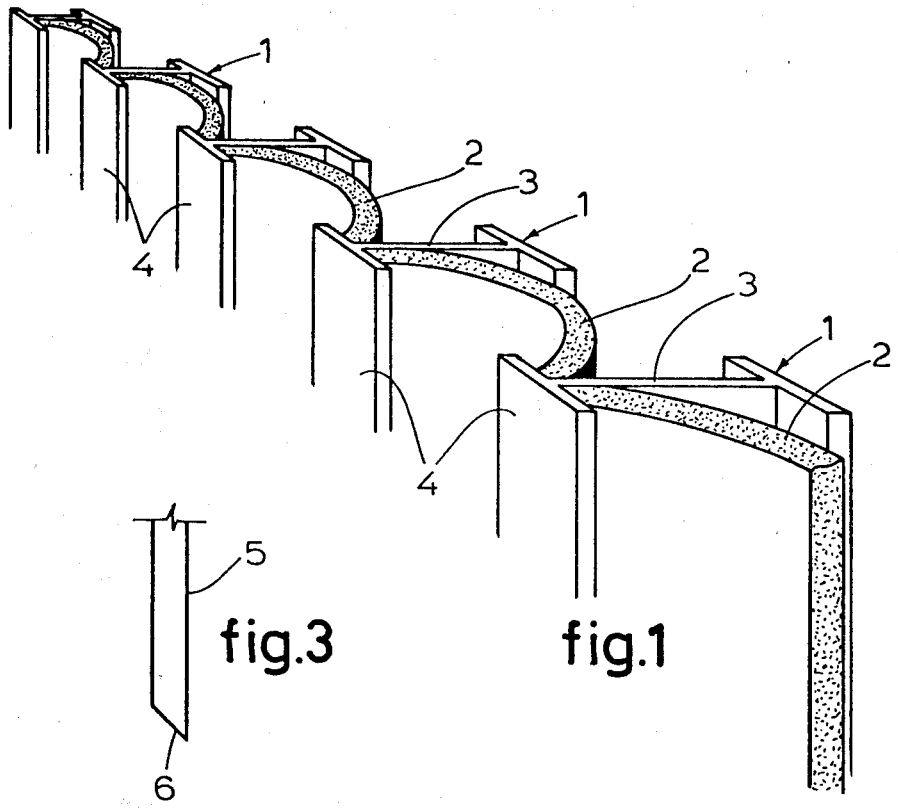
fig.3
fig.1
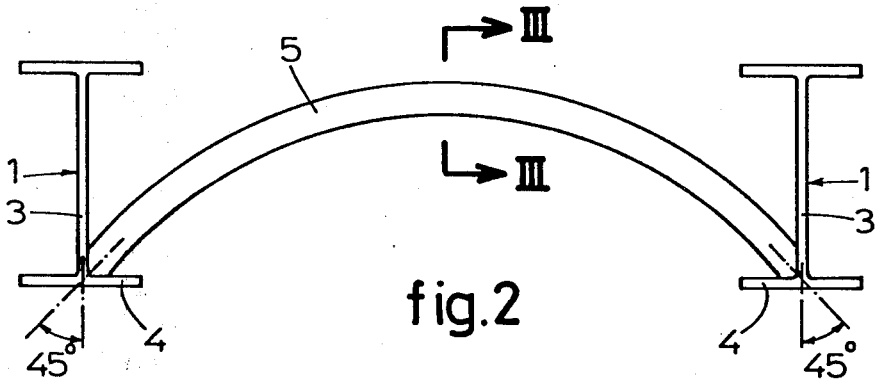
fig.2

SOIL AND/OR WATER-RETAINING WALL; METHOD FOR FORMING THIS SOIL AND/OR WATER-RETAINING WALL; AND FORMING MOULD SUITABLE FOR USE WITH THIS METHOD

The invention relates to a soil and/or water-retaining wall; to a method for forming this soil and/or water-retaining wall, and to a forming mould suitable for use with this method.

For forming soil-retaining walls a method is already known, the "Berlin building method" in accordance with which these walls are built up from load-bearing parts, which consist of steel sections and from intervening retaining portions, which are made up of timber slabs or of prefabricated concrete slabs, these slabs being placed in position manually, one after the other ,during excavation. Such walls, obtained with the use of the Berlin building method, are unsuitable for retaining water because during the construction numerous gaps are formed. Hence these walls can be used exclusively above ground water level. A further difficulty with such known walls is that a great deal of manual labour is necessary.

Further, soil and/or water-retaining walls made of concrete are known which are formed in the soil from adjacent flat sections having a uniform thickness of at least 40 cm. These known soil and/or water-retaining walls require on the one hand a very great deal of concrete material, whilst on the other hand the forming of these walls is rather time-consuming because first of all soil has to be removed by drilling or excavation, whereafter this removed soil is replaced by concrete.

It is an object of the present invention to provide a soil and/or water-retaining wall whereby the above-mentioned disadvantages are effectively removed.

For this purpose, this soil and/or water-retaining wall in accordance with the invention is characterized in that this wall is composed of at least partially prefabricated load bearing uprights and intervening curved shells formed in the soil of concrete or similar hardenable material, which shells connect on both sides without joints to the uprights.

It has been shown that in this way soil and/or water-retaining walls are obtained whereby the integrally formed shells connect on either side with the uprights practically hermetically. Thus, the walls in accordance with the invention can be used both as soil-retaining walls and as water-retaining walls and hence can be located below the ground water level if required. Furthermore the forming of the soil and/or water-retaining walls in accordance with the invention lends itself excellently to mechanization, so that practically no manual labour has to be performed.

Preferably the uprights are completely prefabricated.

The uprights may in the first place consist of steel sections, such as H-sections or double U-sections.

As an alternative it is possible for the uprights to consist of reinforced or pre-stressed beams made of concrete or similar hardenable material.

Furthermore it is also possible for the uprights to be made of steel and of concrete or similar hardenable material.

According to a favourable embodiment of the soil and/or water-retaining wall in accordance with the invention, the ends of the intervening curved shells connect with the steel sections in the corner between the web of the section and a flange located at the side of the excavation.

In this embodiment the uprights are the only load-bearing components of the soil and/or water-retaining wall, whilst the intervening curved shells transfer the loads essentially in the horizontal sense to the adjacent uprights. Hence, there is a clear separation between the function of the uprights, which act as load-bearing components, and the function of the intervening shells which form the retaining portions of the wall.

The shells rest on the flange of the uprights, which is located at the side of the excavation, the said flange being subjected to a tensile stress after excavation, at the point of the soil moment in the wall. The shell which is cast against this flange will thus actually have to be subjected to the same elongation as this flange, which could lead to tensile cracking in the horizontal direction in the concrete as this concrete does not have the same elasticity as the steel flange. As a result the water tightness of the soil and/or water-retaining wall can be reduced to a greater or lesser degree under certain circumstances.

In conjunction herewith, in a very important embodiment of the soil and/or water-retaining wall in accordance with the invention, the uprights, made from steel sections, are composed of a tensile portion located at the side of the excavation and a compression portion located at the side of the soil mass, whereby the ends of the intervening curved shells connect with this compression portion of the steel sections.

The compression portion of the steel sections may comprise a web and two flanges, whereby the ends of the intervening curved shells in cross-section completely fill the space between the web and the flange portions, located on the corresponding side, of the compression portion of the steel sections.

In this embodiment there is no sharp separation anymore between the function of the uprights and that of the intervening shells, since these shells are also load-bearing.

With advantage the tensile portion of the steel sections may consist of a flange and of a web with trapezoidal recesses which is welded to a flange of the compression portion.

In this embodiment the shells are effective in two directions, since the shell functions in the vertical sense as a compression flange for the entire wall section, whilst in the horizontal sense the shell retains its function as an arch.

Hence optimum use is made here of the material properties of steel on the one hand and of concrete, or similar hardenable material on the other hand, so that it is possible to obtain a soil and/or water-retaining wall at minimum costs.

According to a further modification of the soil and/or water-retaining wall in accordance with the invention, the uprights consist of a prefabricated core and of a casing of concrete or similar hardenable material which is formed in the soil.

The invention furthermore relates to methods for forming the soil and/or water-retaining walls described hereinabove in accordance with the present invention, and to forming moulds suitable for use with these methods.

The invention will be explained hereinafter with reference to the drawings.

FIG. 1 is a perspective view of a portion of a first embodiment of a soil and/or water-retaining wall in accordance with the invention.

FIG. 2 schematically shows a forming mould which can be used during the forming of the wall according to FIG. 1 and which is clampingly guided between two uprights.

FIG. 3 is a section along the plane III—III in FIG. 2.

Figure 9:
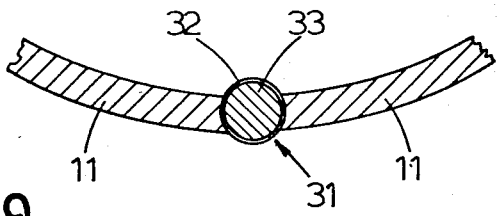
FIG. 9 is a horizontal section of a portion of a modified shell.
Figure 10:
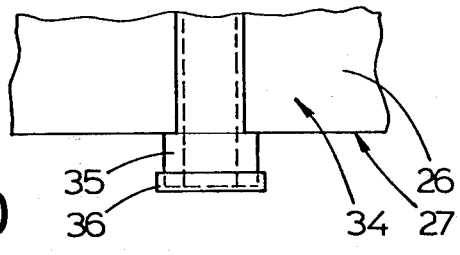

FIG. 10 schematically shows a vertical section of a portion of a modified forming mould for forming a shell in accordance with FIG. 9.

Figure 11:
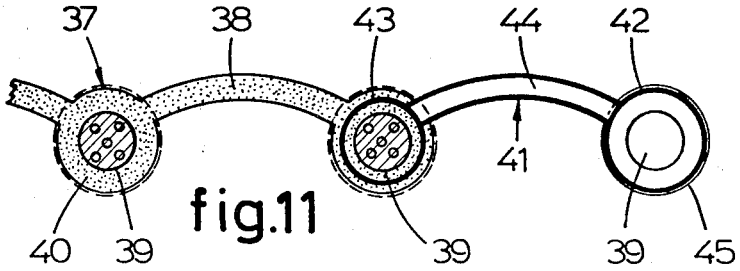

FIG. 11 is a horizontal section of a portion of still another embodiment of the soil and/or water-retaining wall in accordance with the invention, wherein also a forming mould used for forming this wall is shown.

In FIG. 1 a first embodiment is illustrated of a soil and/or water-retaining wall in accordance with the invention. This wall is composed of completely prefabricated load-bearing uprights, each of which consists of a steel broad flange girder or H-section 1, and intervening cylindrically curved shells 2, which are formed in the soil of concrete or similar hardenable material and which connect on both sides to the H-sections 1, without joints in a soil-tight and/or water-tight fashion.

As can be seen in FIG. 1, the ends of the shells 2 connect with the H-sections 1 in the corner between the web 3 of the section 1 and a flange 4 located at the side of the excavation. The shells 2 are made without reinforcement.

In FIGS. 2 and 3 a method is elucidated for forming the soil and/or water-retaining wall as shown in FIG. 1. For this purpose the H-sections 1 are introduced into the soil at a mutual spacing of for example 2.00 meters, for example by means of ramming, vibrating or preliminary drilling. Hereafter a steel forming mould 5 is downwardly fed in the soil which mould has practically the same shape and dimensions as the shells 2 to be formed. Preferably this mould 5 is somewhat broader than the clearance between the webs 3 of consecutive H-sections 1.

Prior to its introduction the mould 5 must therefore be bent inwards to some extent so that this mould can be clampingly introduced between the webs 3 of consecutive H-sections 1. This ensures that finally a hermetically sealed connection is obtained between the ends of the shells 2 and the H-sections 1, even if the acutal position of the H-sections 1 should slightly deviate from the theoretically required position.

After the mould 5 has been introduced in the soil to the precise depth this mould 5 is withdrawn again, and simultaneously a mix or mortar of concrete or the like is introduced into the cavity formed underneath the mould 5 and fills this cavity. This mortar is supplied from the top of the mould 5 via one or more channels (not shown) in the mould 5 to discharge apertures in the lower surface of the mould 5. This may take place under pressure or may be done by means of a filling channel having such height that the mortar will flow under the influence of gravity to the lower side of the mould 5.

With the soil and/or water-retaining wall according to FIG. 1, the H-sections 1 take up the loads in the vertical direction, whilst the shells 2 transfer the loads mainly in the horizontal direction to the nearest H-sections 1. This permits major savings in material which, together with the simple, completely mechanized method of working described hereinabove provide an extremely cheap soil and/or water-retaining wall.

In conjunction with the great strength of the shell 2, it should suffice to have a thickness of approximately 10 mm. Such a thickness is however inadequate to enable the mix or mortar of concrete or the like to be distributed uniformly over the distance between consecutive H-sections 1, which for example is 2 meters. For practical reasons the thickness of the shells 2 is made larger and may amount to 50–100 mm, for example. A thickness exceeding 100 mm is again not desirable because the mould 5, as has already been described hereinbefore, must to some extent be capable of elastic deformation.

As shown in FIG. 3, the mould 5 has a slanting foot 6 on its lower side. This slant is such that the mould 5, under the influence of the soil resistance, has its ends pressed strongly into the corners between the web 3 of the neighbouring H-sections 1 and the flange 4 thereof which is located at the side of the excavation.

As shown in FIG. 2, the ends of the mould 5 and thus similarly the ends of a shell 2 formed by this mould enclose an angle of 45° with the plane which connects these ends (and which in the embodiment as shown in FIG. 2 coincides with the plane through the flanges 4 of the H-sections 1, located at the side of the excavation). In this manner it becomes possible for examplle, by means of four shells 2, to define a completely closed cylindrical well, which can be employed for many purposes.

Figure 4:
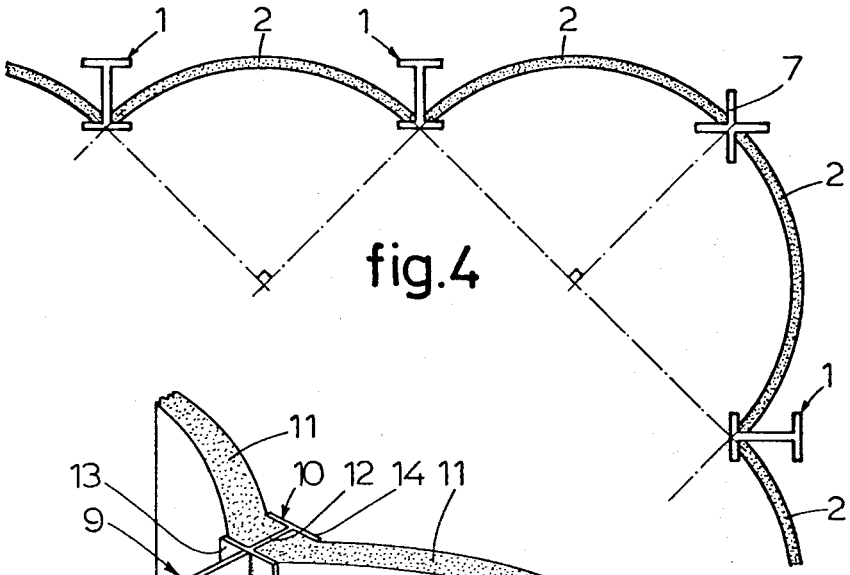
FIG. 4 is a horizontal section of a corner portion of the soil and/or water-retaining wall shown in FIG. 1.

FIG. 4 illustrates a corner portion of the soil and/or water-retaining wall shown in FIG. 1. As can be seen from FIG. 4, a cruciform section 7 has to be employed at the corner point, because here the abutting ends of the shells 2 must extend in line with each other.

Of course, instead of the H-sections 1, it is also possible to use sections of another shape as load-bearing uprights in a soil and/or water-retaining wall in accordance with the invention. It is for example possible to use double U-sections for this purpose, which has the advantage that they can leave an intervening gap for passing through anchors or the like, so as to anchor the top ends of the sections.

Generally, by means of anchors or the like, it will also be possible to anchor the H-sections 1 of the soil and/or water-retaining wall as shown in FIG. 1, for which purpose special drilled holes will have to be made in the H-sections 1 close to the top end thereof.

Furthermore with the soil and/or water-retaining wall in accordance with the invention it is possible for the load bearing uprights to consist of prefabricated, reinforced or pre-stressed beams made of concrete or similar hardenable material.

The load-bearing uprights can also be composed of steel and of concrete or similar hardenable material.

Generally the shells 2 will extend into the soil to a smaller depth than the uprights.

One advantage of the method described hereinbefore for forming a soil and/or water-retaining wall consists in the fact that the soil which is displaced during the introduction of the mould 5 into the ground, cannot cause any damage to the shell 2 which has just been formed in the soil, because the intervening upright provides suitable protection against soil displacement.

Furthermore this method has the advantage that the work can be interrupted at any time, because the hardening of the material from which the shell 2 is formed does not impose any problem whatever during the formation in the soil of the next shell 2.

If the wall is required only as a temporary measure in the soil, it can be an advantage to withdraw the uprights again afterwards.

For this purpose the upright can initially be introduced further into the soil over a short distance, for example 10 cm, so as to reduce the adhesion between this upright and the ends of the abutting shells 2 made of concrete or similar hardenable material, whereafter the uprights can easily be withdrawn.

Alternatively it is similarly possible for the uprights, at the point where they connect with the intervening shells 2, to be coated in advance with an anti-adhesion layer, which counteracts the adhesion of the concrete or similar hardenable material to the uprights.

Figure 5:
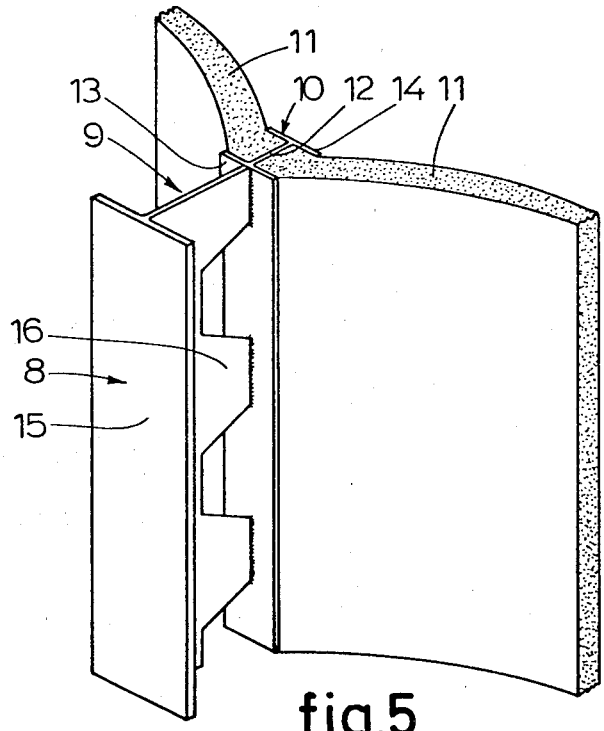
FIG. 5 is a perspective view of a portion of another embodiment of a soil and/or water-retaining wall in accordance with the invention..

FIG. 5 shows a further embodiment of a soil and/or water-retaining wall in accordance with the present invention. Although with the soil and/or water-retaining wall shown in FIG. 1 there is a clear functional separation between the load bearing H-sections 1 and the intervening soil and/or water-retaining shells 2 of the wall, in the case of the wall shown in FIG. 5 this separation no longer exists.

In the embodiment shown in FIG. 1 the shells 2 rest on the flanges 4, facing the side of the excavation, of the load bearing H-sections 1. At the location where the soil moment is exerted on the wall these flanges 4 are subjected to tensile stresses and for this reason will be elongated. The curved shell 2, the ends of which are poured against these flanges 4, must thus follow this elongation. As the concrete or similar hardenable material used for the shell 2 does not exhibit the same elasticity as the steel H-sections 1, it is possible for tensile cracks to occur in the shell material in the horizontal direction, so that under certain conditions the water tightness of the wall can deteriorate.

To obtain an optimum construction also in this respect, in the embodiment shown in FIG. 5 the uprights consisting of steel sections 8 are made up of a tensile portion 9 which is located at the side of the excavation and a compression portion 10 which is located at the side of the soil mass. The ends of the intervening curved shells 11 connect with the compression portion 10 of the steel profiles 8.

In the embodiment shown in FIG. 5 the compression portion 10 of the steel sections 8 consists of a web 12 and of two flanges 13, 14, whereby the ends of the curved shells 11 in cross section completely fill the space between the web 12 and the halves of the flanges 13, 14, located on the corresponding side of the compression portion 10 of the steel sections 8.

In the embodiment shown in FIG. 5 the tensile portion 9 of the steel sections 8 consists of a flange 15 and of a web 16 with trapezoidal recesses, which is welded to the flange 13 of the compression portion 10.

The shells 11 function in the vertical direction as compression flanges of the overall wall and retain their function as an arch in the horizontal direction.

Figure 8:
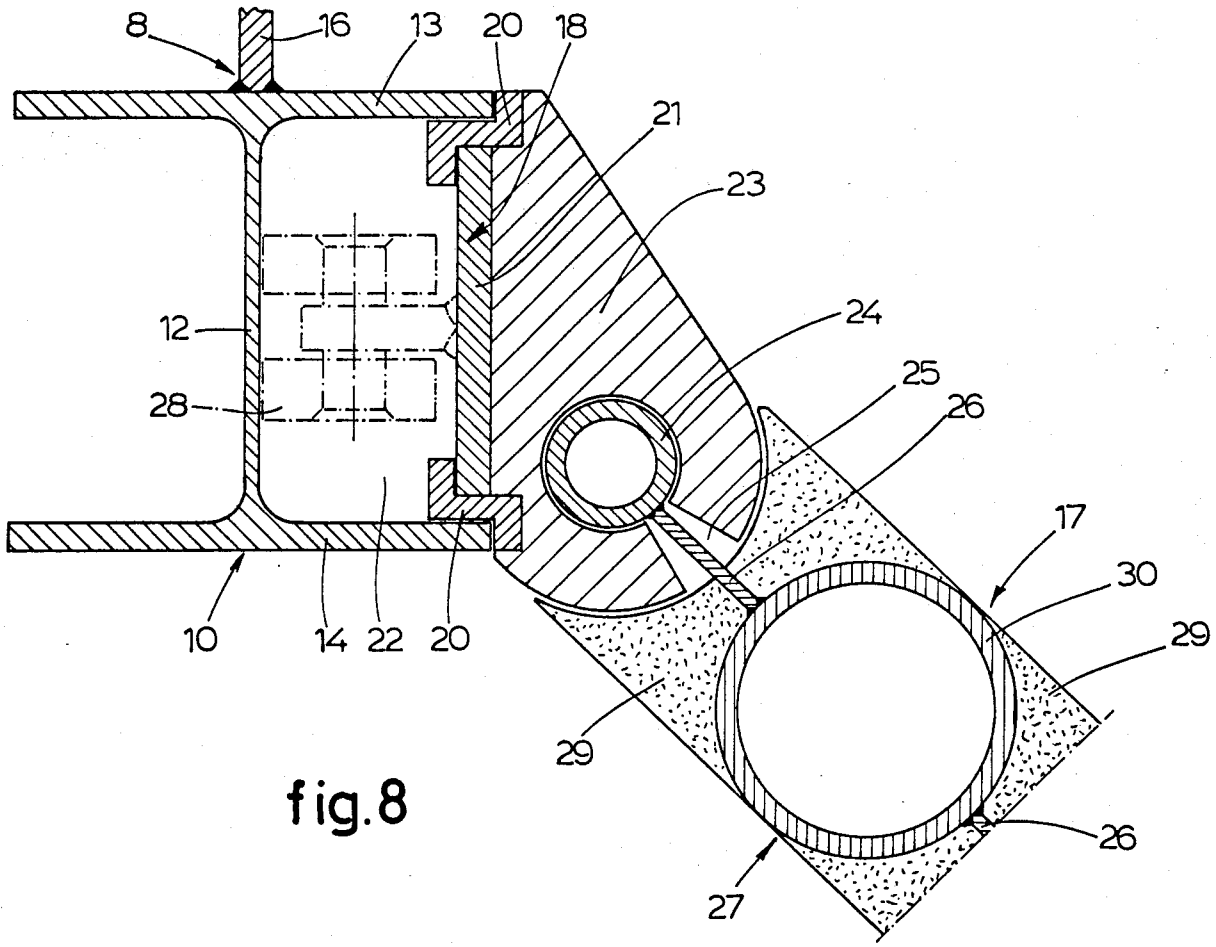
FIG. 8 is a horizontal section of an embodiment of a lateral end portion of the forming mould shown in FIG. 6, or a larger scale.
Figure 7:
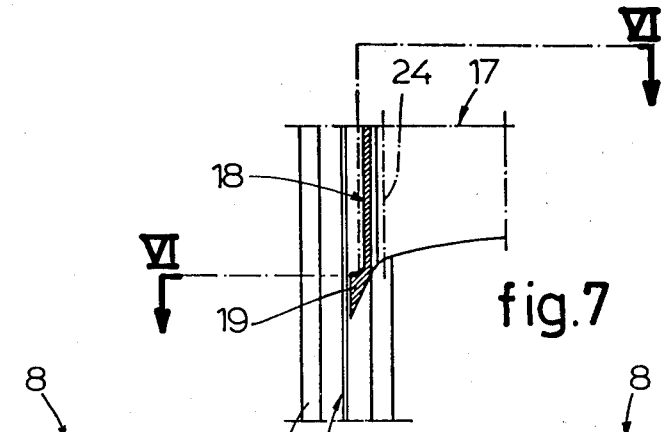
FIG. 7 is a section along the plane VII—VII in FIG. 6.
Figure 6:
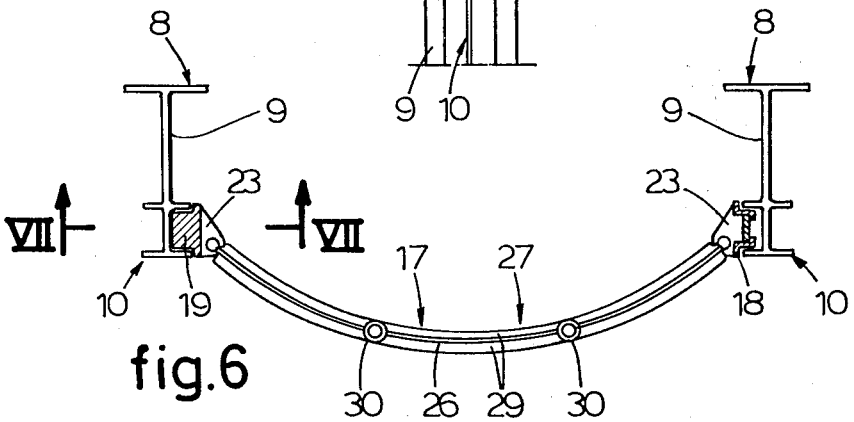
FIG. 6 is a horizontal section along the plane VI—VI in FIG. 7, of an embodiment of a forming mould which can be used for forming the soil and/or water-retaining wall in accordance with FIG. 5 and which is clampingly guided between two uprights.

FIG. 6, 7 and 8 schematically show a forming mould 17 which can be used for the formation of the soil of the curved shells 11 illustrated in FIG. 5. On both sides this mould 17 has a lateral end portion which comprises a slide 18, by means of which the mould 17 is guided down or up along the compression portion 10 of the steel sections 8 which have been previously introduced into the soil. Each slide 18 is terminated by a runner 19 which projects downwards at the bottom, and which has a tapered end edge. This runner 19 fits into the compression portion 10 of the corresponding steel section 8 and serves to remove all the soil which is present between the flanges 13 and 14 and the web 12 of the compression portion 10 of the steel section 8.

Each slide 18 extends over approximately the entire height of the mould 17 up to the runner 19 and is made up of two wear-resistant profiles 20 made of high-grade steel, which fit in slidable fashion over the ends of the flanges 13 and 14 of the compression portion 10 of the steel section 8 and which are connected with an intervening covering plate 21. Together with the wear-resistant profiles 20 and the compression portion 10 of the steel section 8 this covering plate 21 forms a channel 22 which is closed in its horizontal section.

A hinge arrangement is connected with the slide 18 and consists of a housing 23 and a tube 24 which is rotatably mounted therein, but which is not capable of axial displacement; via an ample slot 25 in the housing 23 this tube is connected to the end of a steel plate member 26 which forms the core of the intervening thinner mould portion 27.

Whilst the mould 17 is being introduced into the soil, it is possible to supply water under pressure via the tube 24 to the channel 22, so as to clean the surface of the compression portion 10 of the steel section 8. This water emerges from the runner 19 in the form of a powerful vertical jet.

Since the compression portion 10 of the steel section 8 is kept extremely clean in this manner, it is possible for the covering plate 21 to be provided with a plurality of sets of wheels 28, of which one set is shown in dot and dash lines in FIG. 8. These sets of wheels 28 can roll over the web 12 of the compression portion 10 of the steel section 8. Naturally, instead of rolling over the web 12 of the compression section 10 of the steel section 8, the sets of wheels 28 may also roll over the inner side of the flanges 13 and 14. The use of the sets of wheels 28 considerably reduces the forces on the wear-resistant sections 20, while the friction between the mould 17 and the compression portions 10 of the steel sections 8 during the introduction of the mould 17 into the soil and during the raising of the mould 17, is considerably reduced.

The thinner mould portion 27, which is located between the hinge components connected to the slides 18, and which has a core which consists of the plate member 26 which is made from a high grade material, e.g. steel, comprises on either side of the plate member 26 a filler layer 29 of fairly resilient material, such as wood, so as to obtain the correct thickness. The plate member 26 is built up from sections, between which vertical tubes 30 extend, which serve for the supply of mortar of concrete or the like to the cavity formed underneath the mould 17 whilst this mould is being withdrawn, the said cavity always remaining filled in this manner.

The thinner mould portion 27 is flexible again, so that the mould 17 can always be inserted subject to a certain stress, between two consecutive steel sections 8, even if these are not entirely in the correct position. Of course the hinge constructions between the slides 18 and the plate member 26 make it easier to locate the mould 17 between consecutive steel sections 8.

Under certain circumstances it is impossible to prevent variations in the extent to which soil and/or water-retaining walls displace forward. In such cases the curved shells 11 which are tightly connected on both sides will behave as if they are rigid, so that differences in displacement may result in fracture.

In those cases the danger of fracture can be considerably reduced if, in the shells 11 involved, a vertical hinge 31 is provided (FIG. 9). Such a hinge 31 always transmits the compressive force in the plane of the curved shell 11, but not the load component vertical thereto. The latter-mentioned load will result in a slight angular rotation at the location of the hinge 31.

The hinge 31 shown in FIG. 9 consists of a tube 32 which is filled with a mix or mortar 33 of the same type as that from which the curved shell 11 is made.

The tube 32 once again connects without joint to the abutting portions of the corresponding curved shell 11. The hinge 31 extends over the entire height of the curved shell 11 and will generally be positioned approximately in the centre of this curved shell 11, although this is not essential. The tube 32 has a diameter which is somewhat larger than the thickness of the curved shell 11 at the point of the connection and should consist of a material to which the mortar does not adhere too strongly. In conjunction herewith the tube 32 can for example be made from plastic or be manufactured from steel coated with an anti-adhesion layer, such as a teflon coating.

After the mortar from which the curved shell 11 is made and the mortar in the tube 32 have hardened, both portions of the curved shell 11 can be subjected to a slight angular displacement around the tube 32. In this way stresses in the shell 11 which could result in fracture can be effectively prevented.

FIG. 10 shows in an extremely schematic fashion a portion of a mould 34 which can be used for the formation of a curved shell 11 as shown in FIG. 9. In the thinner portion 27 of the mould a steel tube 35 is fastened which has a diameter somewhat larger than the thickness of the thinner mould portion 27 at the point of connection.

During the insertion of the mould 34 into the soil this tube 35 is closed at its lower side by a loose shoe 36 which remains behind in the soil after withdrawal of the mould 34. The tube 35 is used for the introduction into the soil of the tube 32 of the hinge 31. This tube 32 fits inside the tube 35. Prior to the withdrawal of the mould 34 the mortar 33 is introduced form the top into the tube 32 and fills the tube 32 entirely. During the withdrawal of the mould 34 the tube 32 remains behind in the soil and the mortar used for forming the connecting portions of the curved shell 11 will make jointless contact with the external surface of the tube 32, thus providing a hermetic seal.

FIG. 11 illustrates a modified embodiment of a soil and/or water-retaining wall in accordance with the invention which is made up of partially prefabricated load-bearing uprights 37 and intervening curved shells 38 which are formed in the soil of concrete or similar hardenable material, and which connect on both sides to the uprights 37.

In the wall illustrated in FIG. 11 the uprights 37 consist of a prefabricated reinforced or pre-stressed beam 39 made of concrete or similar hardenable material which is surrounded by concrete 40 poured in the soil. The prefabricated element 39 can similarly consist of a steel section.

For forming the wall shown in FIG. 11 it is possible to use a forming mould 41 which consists of two lateral end portions 42, 43 which form hollow channels, and of an intervening mould portion 44 for forming a curved shell 38.

During the introduction into the soil of the mould 41 the lateral portion 42 is provided with a loose shoe 45. During the introduction of the mould 41 into the soil a prefabricated element 39 may already be accommodated in this end portion 42, or it may be placed in this end portion 42 after the mould 41 has reached the required depth. During the withdrawal of the mould 41 the loose shoe 45 and the prefabricated element 39 which rests on this shoe remain behind in the soil, whilst during the withdrawal a mortar of concrete or the like is supplied underneath the intervening mould portion 44 and around the prefabricated element 39. Hereupon the mould 41 is displaced so that the lateral end portion 43 is located exactly above the prefabricated element 39 which has just been placed in position. Hereafter the mould 41 is again brought to the desired depth whereby the channel forming the lateral end portion 43 is guided by the prefabricated element 39. The process is repeated until the complete wall has been formed. The channels which form the lateral end portions 42, 43 preferably extend without too much play around the prefabricated element 39.

Furthermore it can be an advantage if the lateral end portion 42 in which the prefabricated element 39 is placed has somewhat larger dimensions than the lateral end portion 43 which slides around the pefabricated element 39 already placed in position. This ensures that the friction is defined by that of the fresh mortar and not by that of the soil. In this embodiment the intervening shells 38 are once again not reinforced and have a thickness of 50–100 mm.

The invention is not restricted to the embodiment shown in the drawing, which may be varied in different ways within the scope of the invention.

I claim:

1. A soil and water retaining wall for protecting an excavation from the soil around it, and comprising:

a plurality of spaced prefabricated uprights which are introduced into the soil;

said uprights consisting of steel sections composed of:

a compression portion disposed towards the soil and having a first web, and two first flanges forming a space therebetween; and a tensile portion disposed towards the excavation and having a second web welded to one of said first flanges, and a second flange; and a plurality of intervening curved shells extending between said prefabricated uprights, said shells being formed of concrete or other hardenable material and being connected to said uprights without joints by ends which completely fill the space between the first web and the first flanges of said compression portion.

2. Soil and/or water-retaining wall according to claim 1, characterized in that upright hinges are incorporated in the curved shells.

3. Soil and/or water-retaining wall according to claim 2, characterized in that each hinge consists of a tube which is filled with mortar and whose diameter is somewhat larger than the thickness of the adjacent portions of the curved shells.

4. Soil and/or water-retaining wall according to claim 3, characterized in that the tube consists of plastic.

5. Soil and/or water-retaining wall according to claim 1, characterized in that the top ends of the uprights are anchored by means of anchors or the like.

6. Soil and/or water-retaining wall according to claim 1, characterized in that the intervening curved shells are not reinforced and have a thickness of 50–100 mm.

7. Soil and/or water-retaining wall accordng to claim 1, characterized in that the intervening curved shells enclose an angle of 45° with the plane which connects their ends.

* * * * *